United States Patent [19]

Kimble

[11] 4,381,690

[45] May 3, 1983

[54] CYMBAL STAND

[75] Inventor: Thomas E. Kimble, Covington, Ky.

[73] Assignee: Baldwin Piano & Organ Company, Cincinnati, Ohio

[21] Appl. No.: 239,449

[22] Filed: Mar. 2, 1981

[51] Int. Cl.[3] ..... G10G 5/00

[52] U.S. Cl. ..... 84/422 R; 84/421; 248/171; 248/188.9

[58] Field of Search ..... 84/421–422; 248/171, 188.9

[56] References Cited

U.S. PATENT DOCUMENTS

| | | | |
|---|---|---|---|
| 617,611 | 1/1899 | Strickland | 248/171 |
| 2,613,901 | 10/1952 | Tatar | 248/171 |
| 3,336,827 | 8/1967 | Gaylor | 84/422 H |
| 3,464,305 | 9/1969 | Meazzi et al. | 84/422 H |
| 4,111,095 | 9/1978 | Simons | 84/422 H |

FOREIGN PATENT DOCUMENTS

| | | | |
|---|---|---|---|
| 119622 | 9/1947 | Sweden | 84/422 H |

*Primary Examiner*—Lawrence R. Franklin
*Attorney, Agent, or Firm*—Frost & Jacobs

[57] ABSTRACT

A cymbal stand is taught comprising upper and lower tubular members in adjustable telescoping relationship. A pedal frame is affixed to the bottom end of the lower tubular member. The rearward end of a foot pedal is pivotally connected by a pair of arms to the pedal frame. The forward end of the foot pedal is pivotally attached directly to an actuating rod assembly extending upwardly through the pedal frame and the upper and lower tubular members. The pivotal attachments of the foot pedal arms to the pedal bracket and the forward end of the pedal to the rod assembly are coaxial, so that the pedal is swingable beneath the pedal frame between an operating position to one side of the pedal frame and a stowed position alongside the pedal frame and the lower tubular member on the other side of the pedal frame. The structure is provided with a set of pivotally attached legs terminating in footed free end. The footed free ends are swingable between a downwardly extending supporting position and an upwardly extending stowed position alongside the lower tubular member. The upper end of the upper tubular member supports an improved lower cymbal mounting and tilting assembly. An improved attachment assembly mounts the upper cymbal to the upper end of the actuating rod assembly above the lower cymbal.

18 Claims, 16 Drawing Figures

CYMBAL STAND

TECHNICAL FIELD

The invention relates to a cymbal stand, and more particularly to such a stand provided with an improved pedal assembly and improved cymbal mounting assemblies.

DESCRIPTION OF THE PRIOR ART

The tripod stand portion of the present invention has many applications. For example, it can be used to support snare drums, a microphone boom, or the like. It can also be used as a stool, supporting an appropriate seat member. The stand, however, is particularly adapted for use as a support for a pair of cymbals. Such stands are generally well known in the art and are frequently referred to as high-hat stands. The pair of cymbals supported by such a stand are generally referred to in the art as high-hat cymbals.

Prior art workers have devised numerous embodiments of high-hat stands. Exemplary embodiments are taught, for example, in U.S. Pat. Nos. 2,417,972; 3,167,995; 3,299,765; 3,464,305 and 4,145,951. In some embodiments the pedal actuated mechanism is exposed, as in the structures of the above mentioned U.S. Pat. Nos. 3,167,995 and 3,464,305. However, the pedal actuated mechanism is sometimes located within the tubular portions of the stand itself, as shown for example in the above mentioned U.S. Pat. Nos. 3,299,765 and 4,145,951.

Prior art stands have frequently been characterised by a number of drawbacks. For example, they are often of a flexible, floppy and non-rigid nature. The pedal actuated mechanism generally involves flexible linkages such as cables, chains, leather straps and the like which tend to provide problems of noise and inertial shock.

Most prior art stands are capable of some folding for storage. However, the procedures for both storage and set-up are usually complex and difficult. In most instances, the pedal assembly must not only be disconnected from the mechanism it operates, but also from the stand assembly itself. Most typical designs are characterized by loose or dangling components when folded for storage.

In prior art structures, the upper cymbal attachment assembly, by which the upper cymbal is attached to an actuating rod or other means, is again complex in nature with numerous nuts, lock means and the like and tends to score the surface of the upper end of the actuating rod or other holding device.

High-hat stands are often provided with support means for the lower cymbal which also enable the lower cymbal to be titled with respect to the upper cymbal for particular desired musical effects. These cymbal supporting and tilting assemblies have a tendency to be difficult to adjust during use in musical performance.

The present invention is directed to a high-hat stand having no flexible linkages in the actuating system. The vertical cymbal actuating rod assembly is attached directly to the pedal, reducing both noise and inertial shock. There is no bushing at the bottom of the cymbal actuating rod, thereby reducing noise and friction. The stand assembly is rigid when set up. The triangulated members of each leg provide resistance to bending and displacement about the vertical axis of the stand which may occur due to oblique loading of the foot pedal. The legs of the stand are provided with cylindrical feet which will touch the floor at all angularities, thus eliminating need for special configurations of legs or feet. The pedal assembly itself is provided with supports in the form of cylindrical feet which will resist twist if the pedal is contacted obliquely.

The stand of the present invention is capable of being folded for storage without loose or dangling elements. The foot pedal assembly need not be disconnected from the pedal actuating mechanism or the stand itself. The body portion of the stand is made up of an upper tubular member and a lower tubular member, the upper tubular member being telescopically mounted in the lower tubular member. Clamp means are provided which will firmly maintain the upper tubular member at any desired position with respect to the lower tubular member and without scoring or otherwise marring the upper tubular member. A readily accessible and adjustable compression spring provides the resistive force required to operate the pedal to suit the particular musician. Adjustable spurs are also provided to prevent "walk around" of the stand.

An improved upper cymbal attachment assembly is described which protects the upper end of the rod assembly from scoring or marring. This upper cymbal attachment means is of simple construction, is provided with a cymbal isolation sleeve, and is easy to assemble.

At the upper end of the upper tubular member, an improved lower cymbal support and tilt assembly is located which allows fast, accurate tilt setting, and will hold its setting during playing.

DISCLOSURE OF THE INVENTION

According to the invention there is provided a stand for a pair of high-hat cymbals. The stand comprises an upper tubular member and a lower tubular member, the upper tubular member being telescopically received within the lower tubular member and being clampable at any desired relative position with respect to the lower tubular member. A pedal frame is affixed to the bottom end of the lower tubular member. The pedal frame comprises a pair of vertical side frames in parallel spaced relationship and joined together at their upper ends and at an intermediate position. An acutating rod assembly extends vertically through the pedal frame and axially of the upper and lower tubular members. The actuating rod assembly comprises upper and lower actuating rods joined together and a U-bracket affixed to the lowermost end of the lower actuating rod.

The lower tubular member can be clamped to the rim of a bass drum for support or can be provided with three or more legs pivotally affixed thereto and evenly spaced thereabout. Each leg terminates in a free footed end. The footed ends of the legs are swingable between a downwardly depending supporting position and an upwardly extending stowed position alongside the lower tubular member.

A foot pedal is provided, the rearward end of which is pivotally connected to the pedal frame by a pair of foot pedal arms. The forward end of the foot pedal is pivotally connected directly to the U-bracket of the actuating rod assembly. During set-up and knock-down procedures, the pivotal connections of the foot pedal arms to the pedal bracket and the pivotal connection of the forward end of the foot pedal to the U-bracket, which are normally in coaxial relationship, permit the foot pedal assembly to be swingable beneath the pedal frame between an operating position to one side of the pedal frame and a stowed position alongside the pedal frame and the lower tubular member on the other side of the pedal frame.

Within the pedal frame there is a coil spring operatively connected to the pedal frame and operatively and adjustably connected to the lower actuating rod of the actuating rod assembly, enabling adjustment of the force required to operate the pedal and the actuating rod assembly.

A support and tilting assembly for the lower cymbal is mounted at the upper end of the upper tubular member. The support and tilting assembly comprises a base, an adjustment ring having a helical ramp and a tilter plate. The tilter plate supports a felt washer upon which the lower cymbal rests. The tilter plate and adjustment ring are maintained in adjusted position during playing, by means of a spring, as will be described hereinafter.

The upper cymbal is affixed to the upper actuating rod by a novel cymbal holder comprising a cymbal holder body with clamp means for engaging the upper end of the upper actuating rod. The cymbal holder body is provided with an isolation sleeve, a pair of resilient washers mounted above and below the upper cymbal and a friction nut, again as will be described hereinafter.

DETAILED DESCRIPTION OF THE INVENTION

Figure 1:
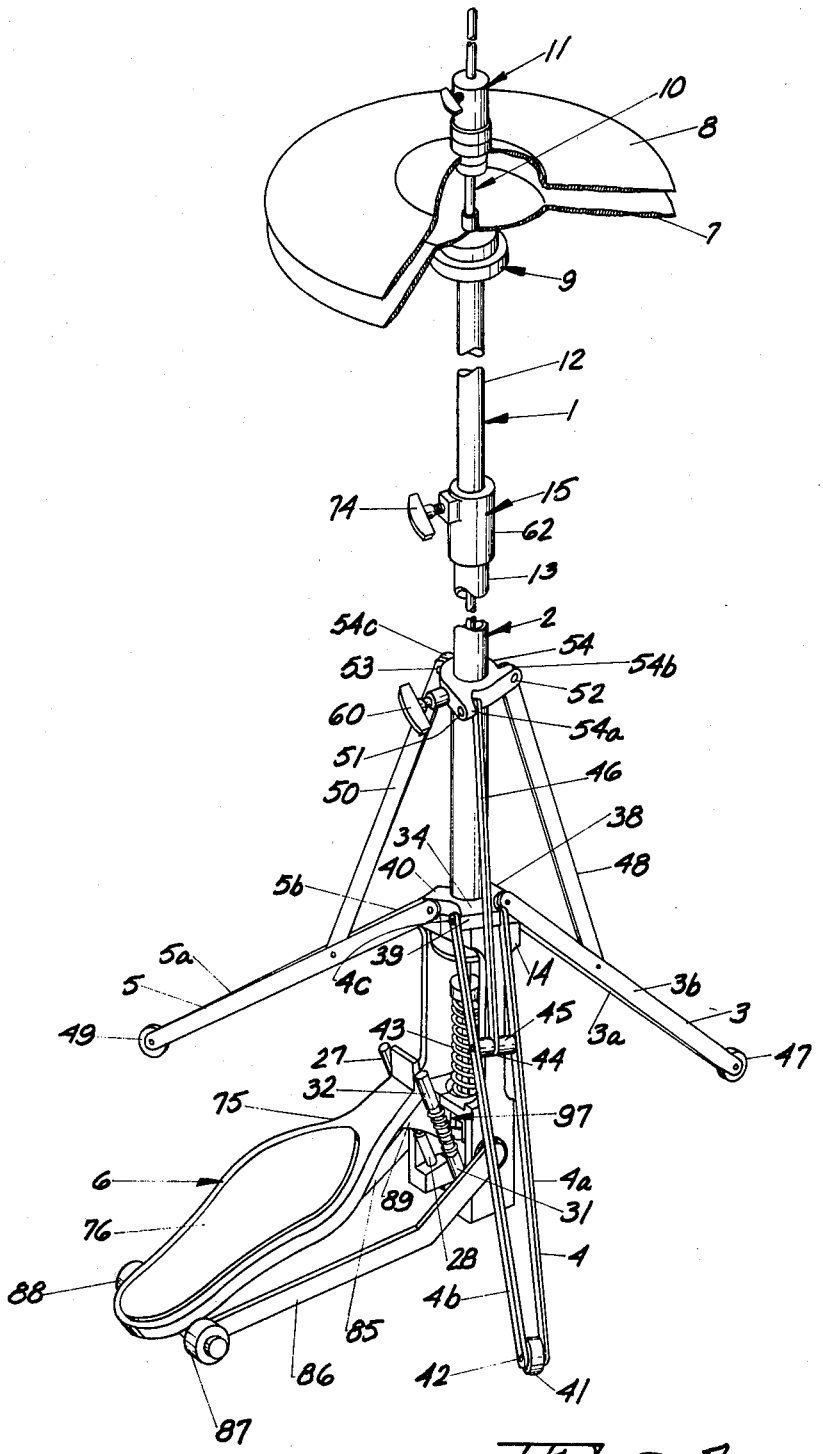
FIG. 1 is a perspective view of the high-hat stand of the present invention.

In all of the Figures, like parts have been given like index numerals. Reference is first made to FIG. 1 wherein the overall stand structure is illustrated. The stand is generally indicated at 1 and comprises a body portion generally indicated at 2 provided with three identical legs 3, 4 and 5. A pedal structure, generally indicated at 6, is operatively connected to the lower portion of body 2. At the upper end of body 2, lower and upper high-hat cymbals 7 and 8 are mounted. The lower high-hat cymbal 7 is mounted on a support and tilting assembly, generally indicated at 9. The upper high-hat cymbal 8 is mounted on an actuating rod assembly, generally indicated at 10, by an upper cymbal holder assembly, generally indicated at 11.

Figure 2:
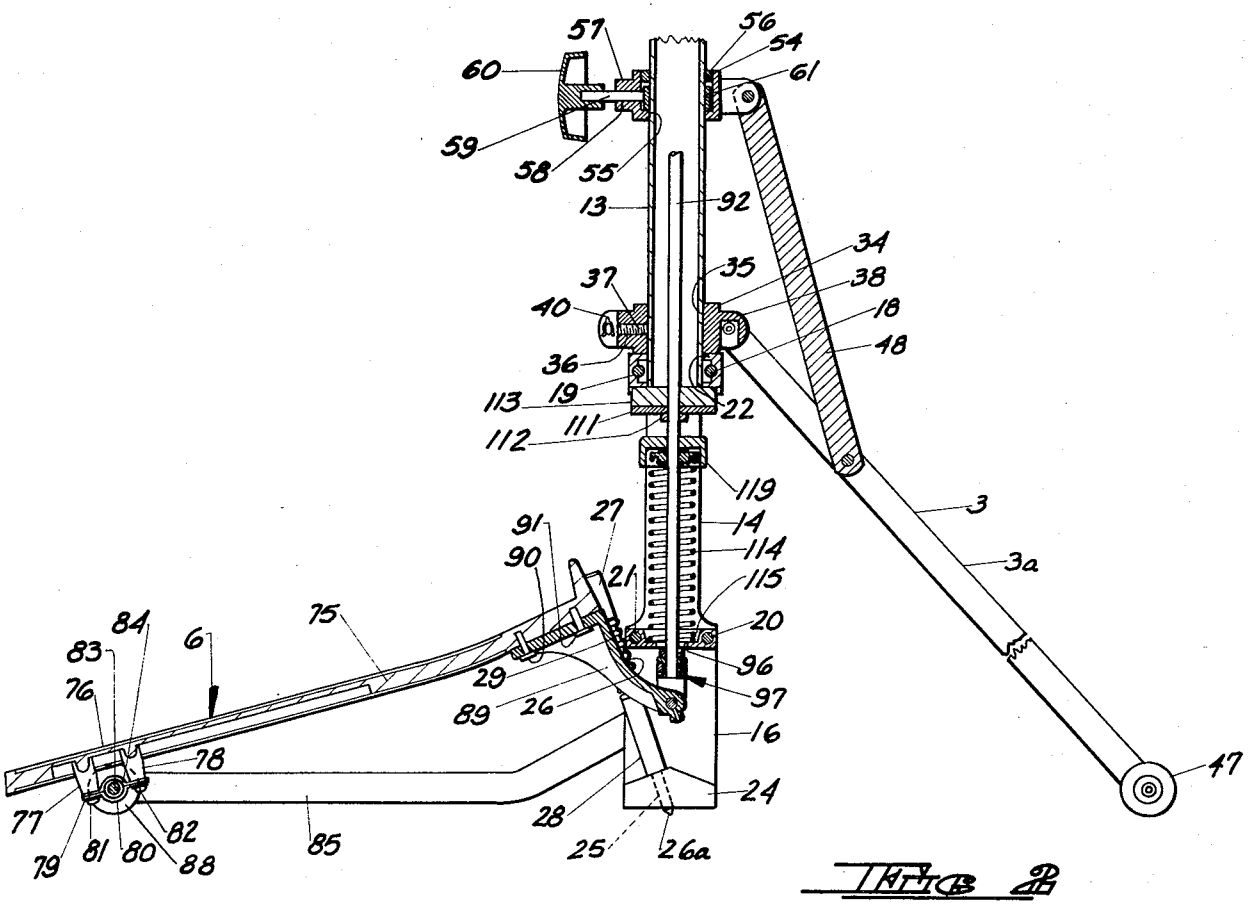
FIG. 2 is a fragmentary, side elevational view, partly in cross section, illustrating the lower portion of the high-hat stand of FIG. 1.
Figure 3:
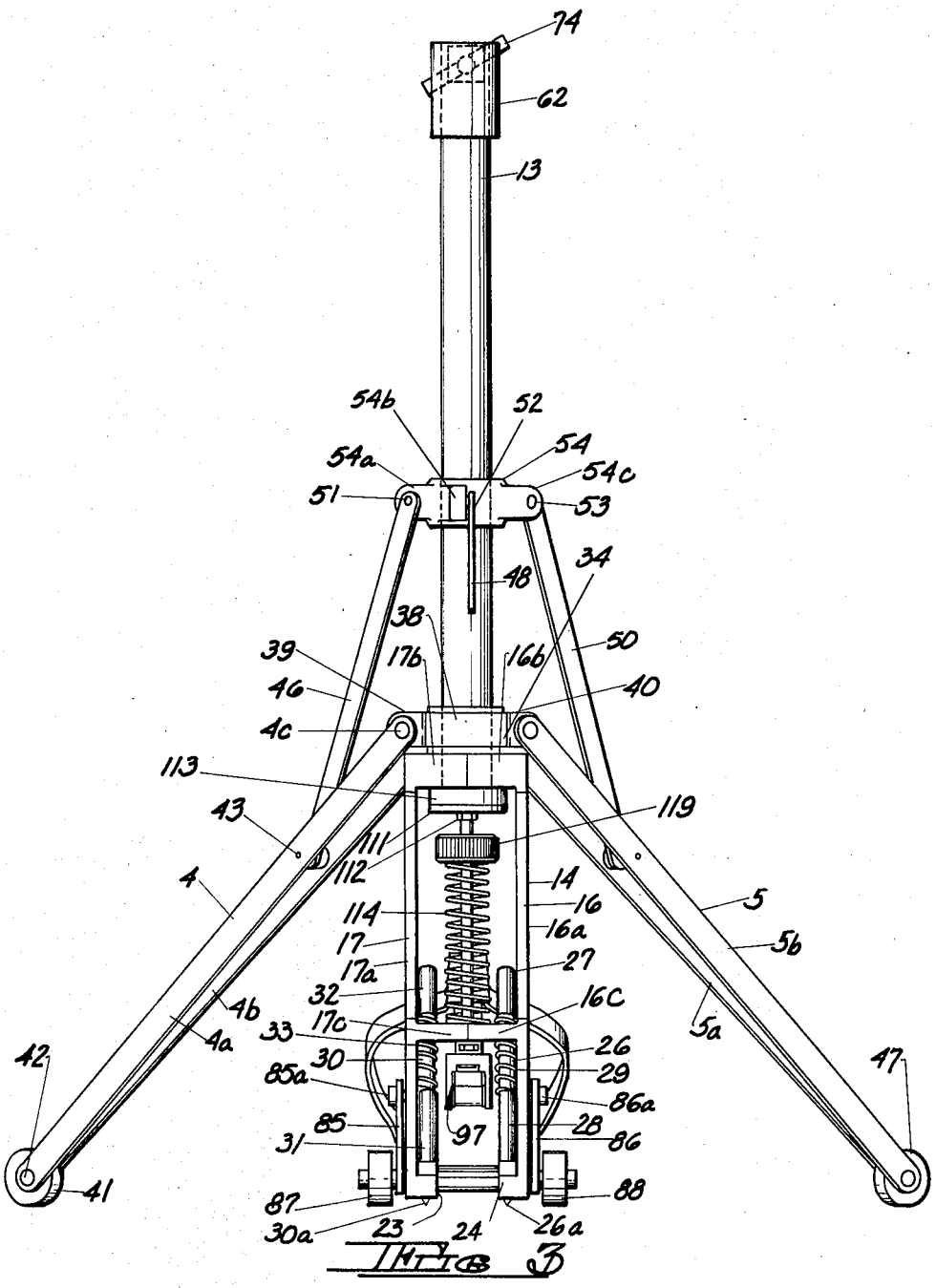
FIG. 3 is a rear elevational view of the lower portion of the high-hat stand of the FIG. 1.

The basic parts of the structure having been identified, the individual parts will now be described in detail. Reference is made to FIGS. 1 through 3. The body 2 of the stand comprises an upper tubular member 12, a lower tubular member 13 and a pedal frame 14. The upper tubular member 12 is telescopically received in lower tubular member 13 and is fixable at any adjusted position with respect thereto by clamping means (generally indicated at 15), to be described hereinafter.

The pedal frame 14 is most clearly shown in FIGS. 2 and 3. Pedal frame 14 is made up of two mirror image halves 16 and 17. The half 16 has a vertical portion **16*a*, an inwardly extending flange 16*b* at its upper end and an intermediate inwardly extending flange 16*c*. In similar fashion, the pedal frame half 17 has a vertical portion 17*a*, an inwardly extending flange 17*b* at its upper end and an intermediate inwardly extending flange 17*c*. The pedal frame halves 16 and 17 are joined together at their upper flanges 16*b* and 17*b* by machine screws 18 and 19 (see FIG. 2). In similar fashion, they are additionally joined together by machine screws 20 and 21 extending through intermediate flanges 16*c* and 17*c* (see FIG. 2**).

The flanges **16*b* and 17*b* have an opening 22 formed therein, one half the opening 22 being formed in each of flanges 16*b* and 17*b*. The opening 22 is of circular configuration and of such diameter as to receive the bottom end of lower tubular member 13** with a clamping fit.

At their lowermost edges, the vertical portions 16 and 17 of pedal bracket 14 have inturned flanges 23 and 24. As can most easily be seen in FIG. 2, the flange 24 has an upper surface which is of inverted V-shaped configuration. The same is true of flange 23. That sloping surface of flange 24, nearest pedal assembly 6, has a threaded perforation 25 extending through the bottom of pedal frame half 16. Threadedly engaged in perforation 25 is a threaded, rod-like spur 26 terminating in a pointed end **26*a* extending below the bottom surface of pedal frame half 17. The upper end of spur 26 is provided with a lightly knurled knob 27. Mounted on the spur and abutting the upper surface of pedal frame flange 24 there is a cylindrical spacer 28. Spur 26 also carries a compression spring 29. One end of compression spring 29 abuts the knob 27, while the other end of spring 29 abuts the upper end of spacer 28. By rotating the knurled knob 27 the amount by which pointed end 26*a* extends below the bottom surface of pedal frame half 16 can be adjusted. Spring 29 assures that the spur remains in adjusted position. In precisely the same manner, the pedal frame half 17 is provided with a spur 30 having a pointed tip 30*a*, a spacer 31, a knob 32 and a compression spring 33. Spurs 26 and 30** tend to stabilize the stand and prevent it from "walking" during playing.

The upper end of pedal frame 14 is surmounted by a leg mount 34. The lower tubular member 13 passes through a central perforation 35 in leg mount 34. Leg mount 34 has a threaded perforation 36 adapted to receive a set screw 37 by which leg mount 34 is rigidly affixed to lower tubular member 13.

Leg mount 34 has three (or more) spaced, radially extending lugs 38, 39 and 40, to which legs 3, 4 and 5 (respectively) are pivotally attached. Legs 3, 4 and 5 are identical. Leg 4 is most clearly shown in FIG. 1 and a description of it should suffice as a description of all of the legs. The leg 4 is made up of a pair of strap-like leg members 4*a* and 4*b*, pivotally attached at their upper ends to either side of lug 39 by means of rivet 4*c*. At their lower ends, there is a cylindrical foot 41 mounted between leg member 4*a* and 4*b*. The cylindrical foot 41 is attached to the leg members by a rivet 42, or other suitable fastening means.

At an intermediate position, a rivet 43 extends between leg portions 4*a* and 4*b*. Mounted on rivet 43 are a pair of spacers 44 and 45 to either side of the lower end of a support arm 46. The rivet 43 passes through a perforation in the lower end of support arm 46 so that support arm 46 is pivotally attached to leg 4.

In similar fashion, leg 3 is made up of two leg members 3*a* and 3*b* and is pivotally affixed to leg mounted lug 38. At its lowermost end leg 3 is provided with a cylindrical foot 47. Pivotally affixed to leg 3 there is a support arm 48. Leg 5 is made up of two leg members 5*a* and 5*b* and is pivotally affixed to leg mount lug 40. The lowermost end of leg 5 is provided with a cylindrical foot 49. Pivotally affixed to leg 5 there is a support arm 50. In FIG. 2, legs 4 and 5 have been eliminated for purposes of clarity. In FIG. 3, leg 3 has been deleted for purposes of clarity. As indicated above, the triangulated members of each leg provide resistance to bending and displacement about the vertical axis of the stand which may occur due to oblique loading of the foot pedal.

The upper ends of support arms 46, 48 and 50 are pivotally attached by means of rivets 51 through 53, respectively, to a slide bracket 54. To this end, slide bracket 54 is provided with 3 evenly spaced outwardly extending lugs 54*a* through 54*c* to which legs 46, 48 and 50 are affixed by the rivets 51, 52 and 53, respectively. As is most clearly seen in FIG. 2, slide bracket 54 has a central cylindrical body portion open at its upper end and closed at its bottom end except for a perforation 55 through which lower tubular member 13 passes with a sliding fit. The upper end of the central body portion of slide bracket 54 is closed by an annular ring 56 having an outside diameter such as to engage the inside surface of the central body portion of slide bracket 54 with a force fit. The annular ring 56 has an internal diameter so sized as to have a sliding fit relationship with lower tubular member 13.

The central body portion of slide bracket 54 has a radially extending boss 57 provided with a threaded bore 58 to receive the threaded shank 59 of a wing screw 60. Located within the central body portion of slide bracket 54 there is an annular clamp ring 61 having an internal diameter greater than the external diameter of lower tubular member 13 and an outside diameter less than the internal diameter of the central body portion of slide bracket 54. The threaded shank 59 bears against annular clamp ring 61, which, in turn, bears against the lower tubular member 13 when wing screw 60 is tightened. This will maintain slide bracket 54 in any desired position on lower tubular member 13, locking it in position without marring or disfiguring the exterior surface of lower tubular member 13.

A similar wing screw arrangement is provided at the upper end of lower tubular member 13 to maintain upper tubular member 12 in any desired vertical telescoping relationship with lower tubular member 13. To this end, reference is made to FIG. 7. A cylindrical sleeve 62 is provided. The sleeve 62 has a first axial bore portion 63 having a diameter substantiy equal to the external diameter of lower tubular member 13. A second bore portion 64 has a diameter substantially equivalent to the external diameter of upper tubular member 13, receiving the upper tubular member with a sliding fit. A third bore portion 65 has a diameter considerably greater than the external diameter of upper tubular member 12. The bore portion 63 receives the upper end of lower tubular member 13 which abuts the shoulder 66 formed between bore portions 63 and 64. The sleeve 62 is fixed to the upper end of lower tubular member 13 by set screws 67 and 68 or by press fit.

Bore portion 65 contains a loose annular clamp ring 69 having an external diameter less than the diameter of bore portion 65 and an internal diameter greater than the external diameter of upper tubular member 12. The upper end of sleeve 62 is closed by an annular ring 70, rendering annular clamp ring 69 captive within sleeve 62. The annular ring 70 has a press fit with bore 65 and an internal diameter such as to receive upper tubular member 12 with a sliding fit. The sleeve 62 has a radially extending boss 71 containing a threaded perforation 72 for receipt of the threaded shank 73 of wing screw 74. As in the case of the operation of wing screw 60 of slide bracket 54, when upper tubular member 12 is in its desired position with respect to lower tubular member 13, wing screw 74 can be tightened. The threaded shank portion 73 of wing screw 74 abuts clamp ring 69, which in turn abuts and clamps upper tubular member 12 without scoring or marring its surface, as would be the case if upper tubular member 12 were contacted directly by the threaded shank 73 of wing screw 74.

The pedal assembly 6 comprises a foot pedal 75, the upper surface of which is provided with a cover or liner 76 of rubber, leather, plastic or the like. Near its rearward end, foot pedal 75 has two pairs of downwardly depending lugs, one pair of which is shown in FIG. 2 at 77 and 78. To these lugs there is mounted a pair of identical brackets 79 and 80 by means of screws, two of which are shown at 81 and 82 in FIG. 2. Brackets 79 and 80 are so configured as to mount a shaft 83 and cylindrical bushing 84. Pivotally mounted on shaft 83, to either side of foot pedal 75 there is a pair of substantially identical foot pedal arms 85 and 86. Also mounted on the ends of shaft 83 is a pair of cylindrical feet 87 and 88. Cylindrical feet 87 and 88, like cylindrical feet 41, 47 and 49 on legs 4, 3 and 5 respectively, may be made of plastic, rubber material such as neoprene, or the like. The provision of cylindrical feet on legs 3, 4 and 5 assure proper engagement of the supporting surface upon which the stand rests, regardless of the angular relationship of the legs. In similar fashion, feet 87 and 88 at the rearward end of foot pedal 75 assure stability of the foot pedal even if contacted obliquely by the player's foot.

The forward ends of foot pedal arms 85 and 86 are affixed to the lower portion of pedal bracket 14 by bolts 85*a* and 86*a*, or the like. At its forward end, foot pedal 75 is provided with a downwardly and forwardly extending tongue 89, affixed to the underside of foot pedal 75 by screws or the like 90 and 91. The tongue 89 could constitute an integral part of foot pedal 75, if desired. The purpose of tongue 89 will be described hereinafter.

Figure 4:
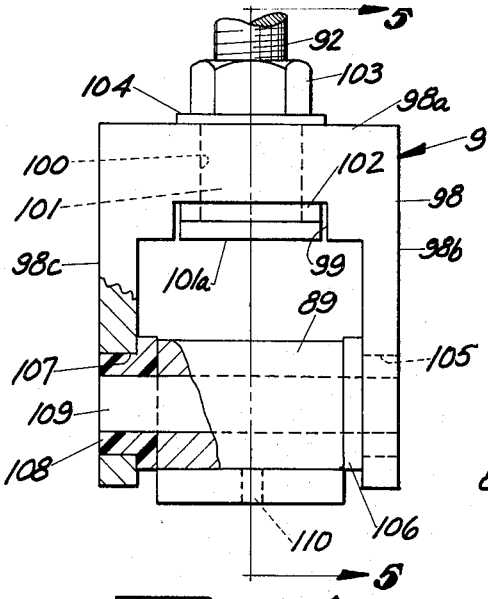
FIG. 4 is a fragmentary elevational view, partly in cross section, illustrating the U-bracket of the actuating rod assembly and the pivotal connection of the forward end of the pedal thereto.
Figure 5:
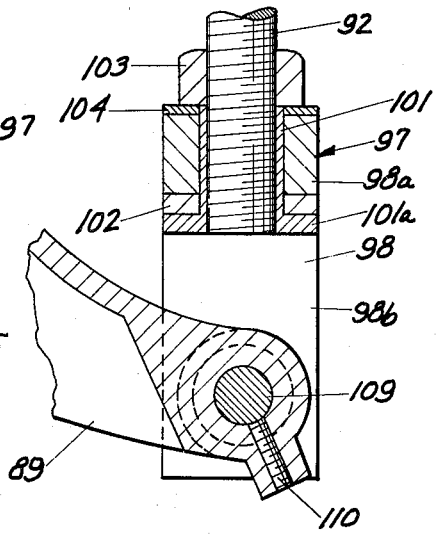
FIG. 5 is a cross sectional view taken along section line 5—5 of FIG. 4.

The actuating rod assembly 10 of the stand of the present invention is made up of a plurality of parts. First of all, it comprises a lower actuating rod 92 (see also FIG. 7) threaded throughout its length and an upper actuating rod 93, threaded at its lowermost end. As is clearly shown in FIG. 7, a cylindrical coupling 94 having an internally threaded axial bore 95 is provided. The lower end of upper actuating rod 93 is threadedly engaged in coupling bore 95, as is the upper end of lower actuating rod 92. The provision of lower actuating rod 92, upper actuating rod 93 and coupling 94 permits breakdown of the stand into a compact structure for storage and transport, upper actuating rod 93 simply being disengaged from coupling 94. The actuating rods 92 and 93 extend substantially axially of upper and lower tubular members 12 and 13. The lowermost end of lower actuating rod 92 extends through a large circular opening 96 in pedal bracket flanges 16*c* and 17*c*, with considerable clearance. The lowermost end of lower actuating rod 92 has a U-bracket (generally indicated at 97 in FIGS. 1 through 3) affixed thereto. U-bracket assembly 97 is most clearly shown in FIGS. 4 and 5. The assembly 97 comprises an inverted U-shaped bracket 98 having a base portion 98*a*, and a pair of downwardly depending legs 98*b* and 98*c*. The base portion 98*a* has a notch 99 formed therein and a perforation 100. The perforation 100 is adapted to receive a threaded bushing 101 having a rectangular flange 101*a* at its lowermost end, so sized as to be received within the notch 99. A rectangular felt washer 102 is located between the flange 101*a* and the base portion 98*a* of U-bracket 98. The bottom end of lower actuating rod 92 is threadedly engaged in bushing 101 and is provided with a lock nut 103. A second felt washer 104 is located between the upper surface of U bracket base portion 98*a* and lock nut 103. The felt washers 102 and 104 allow a small amount of play, permitting the lower actuating rod 92 to properly align itself.

Downwardly depending U-bracket leg 98*b* is provided with a transverse bore 105 having a bushing 106 of nylon or other suitable material located therein. Similarly, downwardly depending U-bracket leg 98*c* has a transverse perforation 107 formed therein, coaxial with perforation 105 in leg 98*b*. The perforation 107 is provided with a bushing 108 similar to bushing 106. The forwardmost end of tongue 89 of foot pedal 95 is received between bushings 106 and 108 and is held in place therebetween by a pin or shaft 109. The shaft is held in place by a set screw 110 in the forwardmost end of foot pedal tongue 89. In this way, the foot pedal 75 is directly connected to the actuating rod assembly 10 without the use of flexible links, cables, leather straps or the like. This arrangement also does away with the necessity of bushing means at the bottom end of lower actuating rod 92 and the noise and friction that are usually caused by such a bushing means.

Reference is now made to FIGS. 2 and 3. To determine the uppermost position of foot pedal 75 and actuating rod assembly 10 and to further eliminate noise, a disk-like support 111 is threadedly engaged on lower actuating rod 92. The disk-like support is held in position by lock nut 112. The support 111 carries a relatively thick resilient pad 113 of felt, cloth, soft rubber or the like, which abuts the upper flange portions 16*b* and 17*b* of pedal bracket 14.

Figure 6:
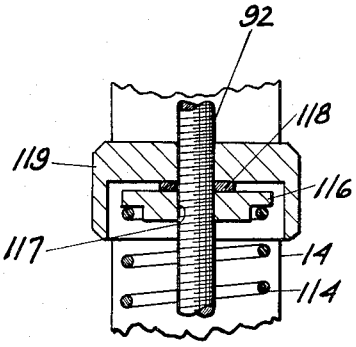
FIG. 6 is a fragmentary cross sectional view of the pedal frame, the lower actuating rod and the adjustment means for the compression spring.

Again referring to FIGS. 2 and 3, together with FIG. 6, means are provided to adjust the force required to actuate foot pedal 75 to suit the individual musician. To this end a compression spring 114 is provided, surrounding the lower end of lower actuating rod 92. Flange portions 16*c* and 17*c* of pedal bracket 14 are provided with an annular depression 115 adapted to receive the lower end of compression spring 114. As can most clearly be seen in FIG. 6, the upper end of compression spring 114 is engaged by a disk-like spring seat 116 having a central perforation 117 through which the lower actuating rod 92 passes with clearance. The seat 116 is surmounted by a washer 118 of plastic or the like. This, in turn, is followed by an adjustment nut 119 threadedly engaged on lower actuating rod 92. By turning adjustment nut 119 in one direction, so that it shifts upwardly along lower actuating rod 92, the compression spring 14 is further relaxed, and the amount of force required to actuate foot pedal 75 is reduced. By turning adjustment nut 119 in the opposite direction so that it shifts downwardly along lower actuating rod 92, the spring 114 is further compressed, increasing the force required to actuate foot pedal 75.

FIGS. 1 through 3 illustrate the hi-hat stand 1 of the present invention fully set up and ready for use. The stand of the present invention is capable of assuming a compact, folded condition for storage and transport. To this end, the upper hi-hat cymbal 8 is removed from actuating rod assembly by means of upper cymbal holder assembly 11, to be described hereinafter. This, in turn, permits removal of lower hi-hat cymbal 7. Thereafter, upper actuating rod 93 can be disengaged from connector 94. By loosening wing screw 74, the upper tubular member 12 can be telescoped within lower tubular member 13 to reduce the length of the structure to a minimum.

Thereafter, wing screw 60 of slide bracket 54 is loosened and shifted upwardly along lower tubular member 13. Through the agency of support arms 48, 46 and 50, the legs 3, 4 and 5 pivot upwardly against lower tubular member 13 to a stowed position, illustrated in FIG. 8.

Figure 8:
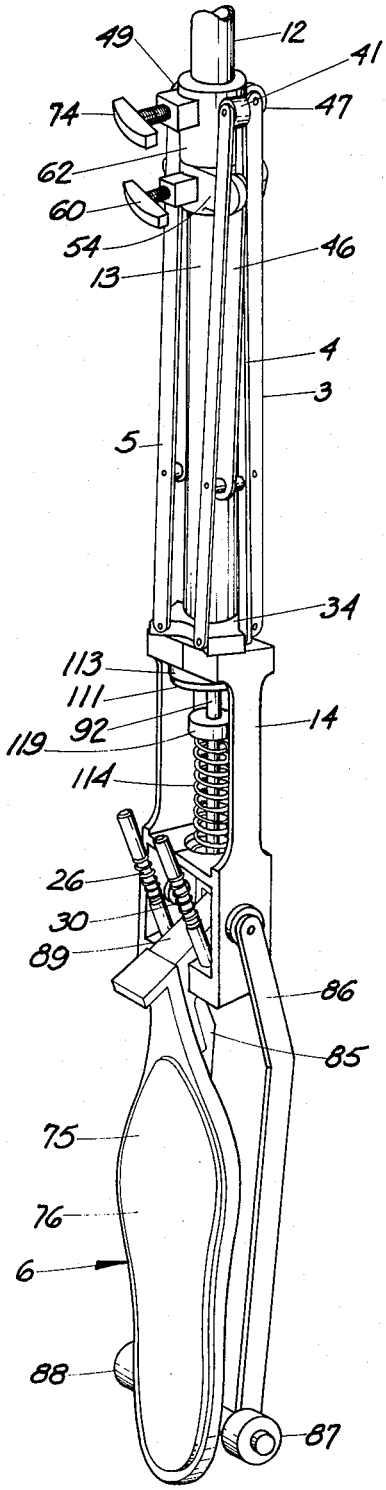
FIGS. 8 and 9 illustrate in sequence the folding procedures for the legs and for the pedal assembly of the high-hat stand of the present invention, to achieve their stowed positions.
Figure 9:
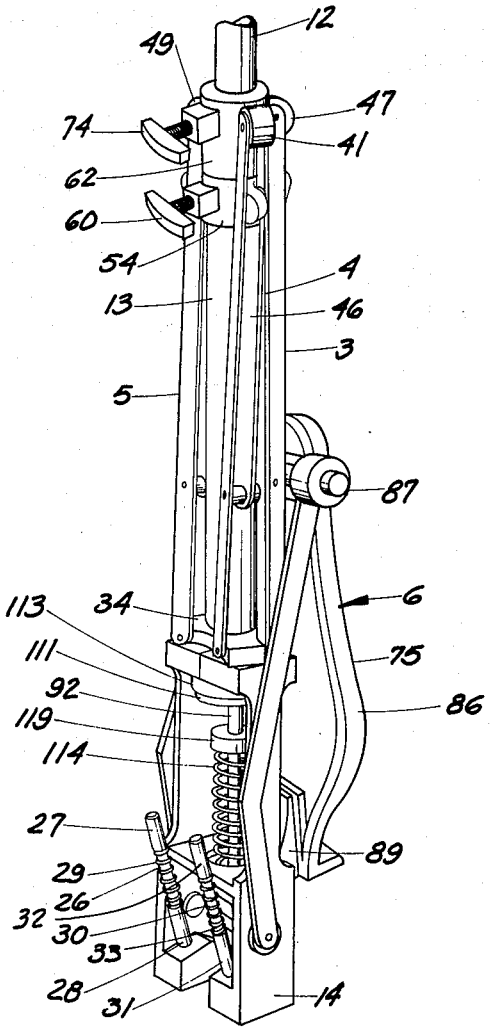

At this point, pedal assembly 6 can be pivoted downwardly, again as shown in FIG. 8. Continued pivoting of the pedal assembly will bring it to its stowed position along side pedal frame 14 and lower tubular member 13. As will be evident from FIG. 9, the stowed position of pedal assembly 6 is on the opposite side of pedal frame from its playing position, the pedal assembly having pivoted substantially 270°. This is made possible by virtue of the fact that during the pivoting of pedal assembly 6, the pivotal attachment of foot pedal arms 85 and 86 by screws 85*a* and 86*a* and the pivotal attachment of foot pedal tongue 89 to U-bracket 98 by pin or shaft 109 are coaxial. The pedal assembly 6 need not be detached from the stand 1 and the foot pedal tongue 89 need not be disconnected from U-bracket 98. To set up the stand 1 from its folded position illustrated in FIG. 9 to its playing position shown in FIG. 1, it is only necessary to reverse the above described steps. If the user prefers to mount the cymbal stand to a heavier or more rigid support, such as a bass drum, the leg subassembly can be removed from stand 1.

The hi-hat stand 1, thus far described can be provided with any appropriate conventional means for supporting lower cymbal 7 at the top end of upper tubular member 12 and upper cymbal 8 on upper actuating rod 93. The present invention contemplates, however, an improved support and tilting assembly 9 for lower cymbal 7 and improved upper cymbal holder assembly 11. The lower cymbal support and tilting assembly 9 will next be described and reference is made to FIGS. 10 through 14 wherein like parts have been given like index numerals.

The support and tilting assembly 9 comprises a base member 120, an adjustment ring 121, a support plate 122, a compression spring 123 and a resilient washer 124. The base member 120 is most clearly shown in FIGS. 11 and 12. The base member comprises a first cylindrical portion 125. The portion 125 is surmounted by an annular disk-like flange 126. On its underside, the annular flange 126 is provided with an inwardly and downwardly tapering portion 127 forming a shoulder 128. As can most clearly be seen in FIG. 10, the cylindrical portion 125 is so dimensioned as to have a force fit within the uppermost end of upper tubular member 12, the top edge of upper tubular member 12 abutting shoulder 128. Alternatively, the cylindrical portion 125 could be maintained within the upper end of upper tubular member 12 by set screws or other appropriate means.

Figure 10:
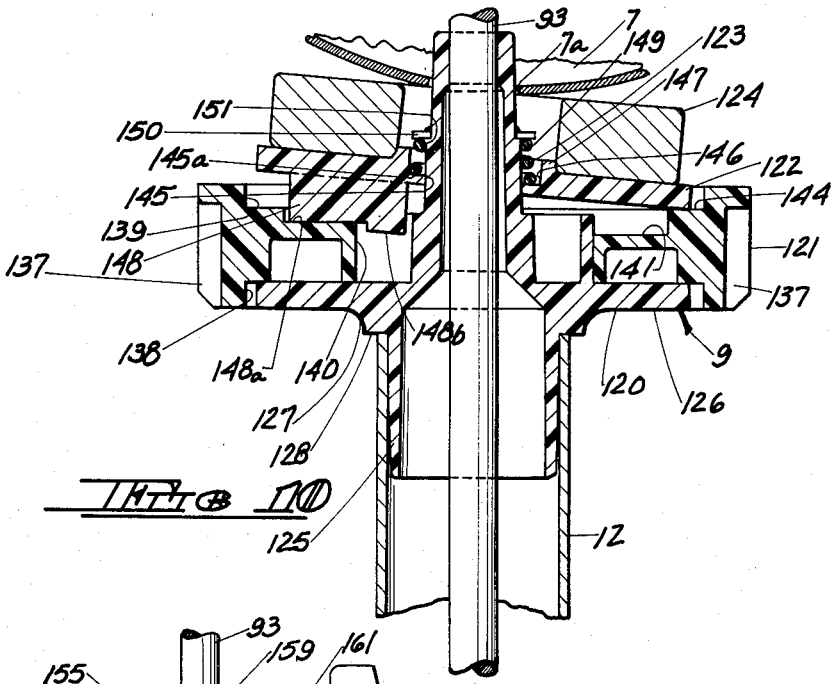
FIG. 10 is a fragmentary cross sectional view illustrating the support and tilting assembly for the lower cymbal.
Figure 11:
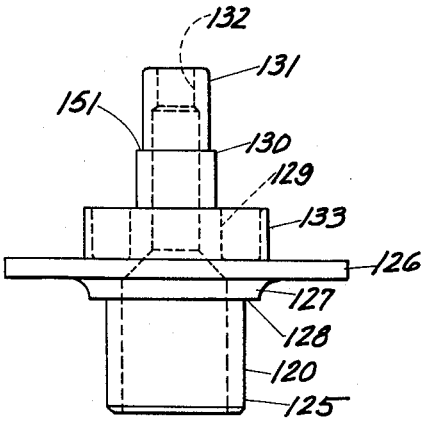
FIG. 11 is a side elevational view of the base member of the support and tilting assembly.

Disk-like flange 126 is, itself, surmounted by a cylindrical, centrally locked member having a first portion 129, a second portion 130 and a third portion 131, each of slightly lesser diameter than the one below, as shown in FIG. 11. The central bore 132 of the uppermost portion 131 has a diameter providing a sliding fit for the upper actuating rod 93, serving as a bushing therefor, (see FIG. 10). The disk-like flange 126 is also provided with an annular wall 133, spaced from the cylindrical portion 129 and of substantially the same height. As is clearly shown in FIG. 12, annular wall 133 has a notch 134 formed therein, with webs 135 and 136 joining it to the cylindrical portion 129. The purpose of notch 134 will be explained hereinafter. Base member 120 can be made of metal or the like. It lends itself well, however, to being molded of an appropriate plastic material.

Figure 13:
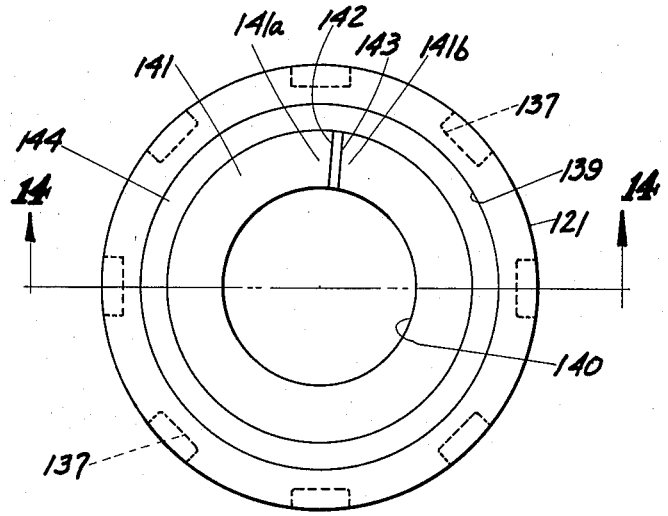
FIG. 13 is a plan view of the adjustment ring of the support and tilting assembly.
Figure 14:
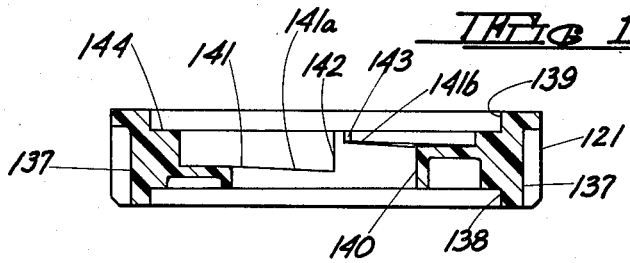
FIG. 14 is a cross sectional view taken along section line 14—14 of FIG. 13.
Figure 12:
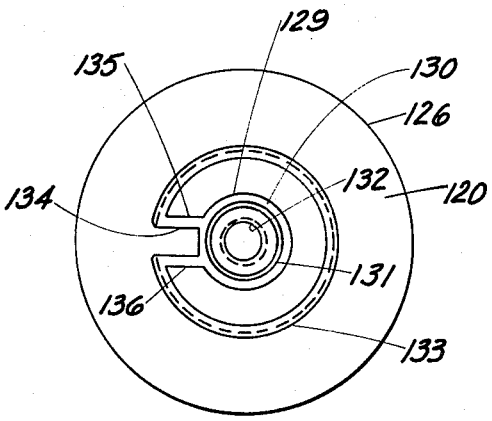
FIG. 12 is a plane view of the base member of the support and tilting assembly.

Adjustment ring 121 is illustrated in FIGS. 13 and 14. This ring-like member may have a plurality of equally spaced notches or depressions 137 formed in its peripheral surface. The depressions 137 are not only decorative, but also enable the adjustment ring to be conveniently grasped and turned by the hand of the musician, as will be further described hereinafter.

The central bore of adjustment ring 121 has a first portion 138 of such diameter as to receive the disk-like flange 126 of base member 120 with clearance (see FIG. 10). In similar fashion, the bore has an upper portion 139 adapted to receive tilter plate 122 with clearance. The central portion 140 of the bore is of such diameter as to just nicely receive annular wall 133 of base member 120 to permit the adjustment ring to be turned about this annular wall. Adjacent the bore portion 140, the adjustment ring 121 has a helical ramp 141 formed therein. The lowermost portion 141*a* of ramp 141 terminates in a vertical wall surface 142. In similar fashion, the uppermost portion 141*b* of ramp 41 terminates in a vertical wall portion 143. Adjustment ring 121 has an annular surface 144 extending between bore portion 139 and ramp 141. The annular surface 144 serves a purpose to be described hereinafter. Adjustment ring 121, as in the case of base member 120, may be made of metal or the like. Preferably, however, it is molded of an appropriate plastic material.

Tilter plate 122 comprises a disk-like member of circular configuration. The tilter plate (see FIG. 10) has a central perforation with a first portion 145 being of such diameter as to accept cylindrical portion 130 of base member 120 with clearance and a second portion 146 of greater diameter. The portion 146 is surrounded by an upstanding flange 147. The upper surface of tilter plate 122 supports the resilient washer 124 of felt, cloth, soft rubber or the like, which may be adhered thereto by an appropriate adhesive (not shown).

On its underside, tilter plate 122 has a downwardly depending lug 148. The lug 148 has a lower surface portion 148*a* adapted to ride on helical ramp 141. The lug 148 has an extended portion 148*b* which extends into notch 134 in annular wall 133 of base member 120.

To complete the lower cymbal support and tilting assembly 9, a helical spring 149 is provided (see FIG. 10). Helical spring 149 is so configured that from its bottom end to its upper end, its convolutions are of decreasing diameter. The bottom end of spring 149 seats on shoulder 145*a* formed between bore portions 145 and 146 in tilter plate 122. The upper end of spring 149 abuts a spring seat 150. Spring seat 150 may be in the form of an annular clip having a force fit over cylindrical portion 131 of base member 120 and resting on shoulder 151 formed between the base member cylindrical portions 130 and 131. Alternatively, seat 150 could be an annular flange constituting an integral, one-piece part of base member 120. The purpose of spring 149 is to constantly load tilter plate 122 into its proper seated relationship with respect to adjustment ring 121 and to maintain adjustment ring 121 in its proper seated condition with respect to base member 120.

Lower cymbal 7 is adapted to rest upon felt or cloth washer 124. To this end, the cymbal 7 has a central perforation 7*a* adapted to accommodate the upper cylindrical portion 131 of base member 120 with clearance, as shown in FIG. 10.

The operation of support and tilting assembly 9 may be described as follows. Since spring 149 assures that tilter plate 122 and adjustment ring 121 always remain in proper seated condition with respect to each other and base member 10, and since lug portion 148*b* always remains in notch 134 of base member annular wall 133, it will be understood that when adjustment ring 121 is turned, tilter plate 122 does not turn with it, but rather remains in the same relative position with respect to base member 120.

As adjustment ring 121 is turned in a clockwise direction (as viewed in FIGS. 10, 13 and 14), the surface 148*a* of tilter plate flange 148 will ride along ramp 141 of adjustment ring 121 until it reaches the uppermost part 141*b* of ramp 141 and abuts wall surface 143. In FIG. 10, tilter plate 122 is illustrated in this position of greatest tilt. It will be noted from FIG. 10 that spring 149 assures that that portion of tilter plate 122 opposite downwardly depending lug 148 remains in contact with the annular surface 144 of adjustment ring 121.

When the adjustment ring 121 is turned in a counter clockwise direction (as viewed in FIGS. 10, 13 and 14), the surface 148*a* of downwardly depending tilter plate lug 148 will shift downwardly along ramp 141 to its lowermost position at 141*a* on the ramp and in abutment with wall surface 142. When this position is achieved, tilter plate 122 will be horizontal and in full contact with adjustment ring annular surface 144. The tilter plate 122 can be made of metal. Preferably, as in the case of adjustment ring 121 and base member 120, the tilter plate is molded of an appropriate plastic material.

Figure 15:
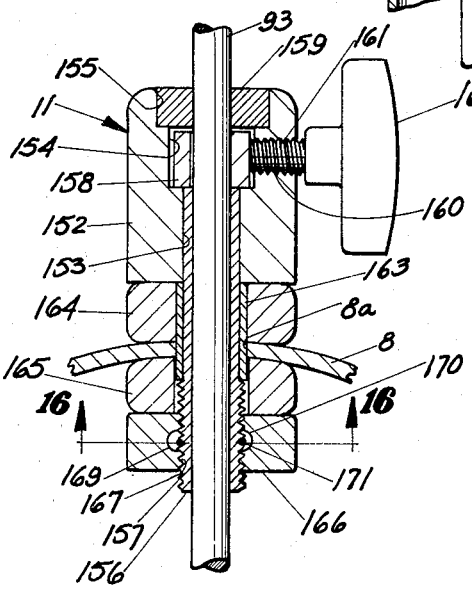
FIG. 15 is a fragmentary cross sectional view of the upper cymbal holder assembly.
Figure 16:
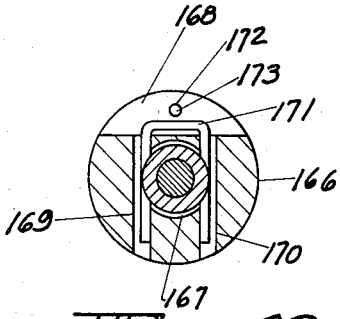
FIG. 16 is a cross sectional view taken along section line 16—16 of FIG. 15.

The improved upper cymbal holder assembly 11 of the present invention is illustrated in FIGS. 15 and 16. The upper cymbal holder assembly 11 constitutes a means by which upper cymbal 8 is adjustably affixed to the upper actuating rod 93.

The upper cymbal holder assembly 11 comprises a first body portion 152 having a central bore comprising a first portion 153, a second portion 154 and a third portion 155. As can be seen in FIG. 15, bore portion 154 is of greater diameter than bore portion 153 and bore portion 155 is of greater diameter than bore portion 154. A second body portion 156 is in the form of a tubular member, the upper end of which is engaged in bore 153 of first body portion 152 with a force fit. The lower end of second body portion 156 is threaded as at 157. The internal diameter of second body portion 156 is such that it receives the upper actuating rod 93 with a sliding fit. It will be understood by one skilled in the art that body portions 152 and 156 could constitute a single, integral, one-piece structure. Both are preferably made of metal.

Figure 7:
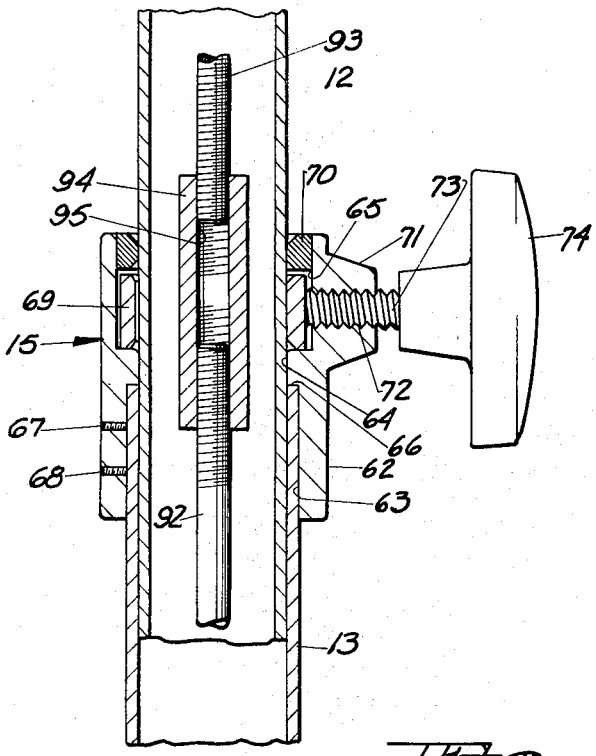
FIG. 7 is a fragmentary cross sectional view of the upper and lower tubular members and the clamping assembly therefor.

Loosely located within bore portion 154 of first body portion 152 there is a clamping ring 158 similar to clamping ring 69 of FIG. 7. Clamping ring 158 has an internal diameter greater than the diameter of upper actuating rod 93 and an external diameter less than the diameter of bore portion 154. The clamping ring 158 is maintain captive within bore portion 154 by means of a retainer or cap ring 159 located in bore portion 155 with a force fit.

Body portion 152 has a transverse threaded perforation 160 intersecting bore portion 154. The threaded perforation 160 accommodates the threaded shank 161 of wing screw 162. When wing screw 162 is tightened, it causes clamping ring 158 to engage upper actuating rod 93, thereby clamping the upper cymbal holding assembly 11 in adjusted position on the upper actuating rod 93, without marring the upper actuating rod.

The second body portion 156 has an isolation sleeve 163 mounted thereon between its threaded portion 157 and first body portion 152. Isolation sleeve 163 may be made of heat shrinkable polyvinyl chloride or other appropriately soft material to isolate the lower cymbal from shock or vibration in the structure.

Upper cymbal 8 has a central perforation **8*a* of such size as to clear isolation sleeve 163. Resilient washers 164 and 165 (of felt, cloth, soft rubber or the like) are located above and below cymbal 8, respectively. It will be evident that isolation sleeve 163 prevents metal-to-metal contact between cymbal 8 and the second body portion 156**.

To maintain the cymbal 8 in position on the upper cymbal holder assembly 11, there is provided a friction nut 166. Friction nut 166 is shown in both FIGS. 15 and 16. The friction nut comprises a disk-like member having a central threaded perforation 167 adapted to threadedly engage the portion 157 of second body portion 156, as shown in FIG. 15.

Friction nut 166 has a notch 168 formed therein (see FIG. 16). Extending transversely to the threaded axis, through the friction nut from notch 168, there is a pair of transverse bores 169 and 170 which intersect threaded bore 167 of the nut. A U-shaped friction spring 171 is located in notch 168 with its legs extending into bores 169 and 170 and frictionally engaging the threaded portion 157 of the second body portion 156. A second threaded perforation 172, parallel to threaded perforation 167 is provided in friction nut 166, intersecting notch 168. The threaded perforation 172 is adapted to receive a scew 173 which also intersects notch 168 and retains friction spring 171.

Felt washer 164 is mounted on the upper cymbal holding assembly 11, as is upper cymbal 8. This is followed by felt washer 165 and friction nut 166. The friction nut 166 is tightened until cymbal 8 is firmly mounted on the assembly. The friction nut 166 is maintained in its desired position by friction spring 171. The entire assembly is then mounted on upper actuating rod 93, located in its desired position, and then locked thereon by means of wing screw 162.

When the high-hat stand 1 of the present invention is set up as described above, the upper actuating rod 93 is connected to lower actuating rod 92 by screwing it into coupling 94 (see FIG. 7). Thereafter, the lower cymbal is mounted on the support and tilting assembly 9 and the upper cymbal 8 is mounted on upper actuating rod 93 by means of upper cymbal holding assembly 11. The desired position of lower cymbal 7 is achieved by rotation of adjusting ring 121 and the desired force required to actuate pedal 75 is adjusted by means of nut 119 (see FIG. 6). The high-hat stand is then ready for use.

Modifications may be made in the invention without departing from the spirit of it.

What is claimed is:

1. A cymbal stand for supporting a pair of upper and lower high-hat cymbals, said stand comprising a tubular assembly having upper and lower ends, a pedal frame affixed to the lower end of said tubular assembly and extending downwardly therefrom, a foot pedal having a forward end adjacent said pedal frame and a rearward end away from said pedal frame, a pair of arms, said arms at one end thereof being pivotally affixed to opposite sides of said pedal frame, said arms at the other end thereof being pivotally affixed to opposite sides of said foot pedal toward said rearward end, an actuating rod extending vertically within said tubular assembly and having an upper end extending above said upper end of said tubular assembly and a lower end extending within said pedal frame, means to pivotally attach said forward end of said foot pedal to said lower end of said actuating rod, said pivotal attachment of said arms to said pedal frame and said forward end of said foot pedal to said actuating rod being coaxial, said foot pedal being swingable beneath said pedal frame and said actuating rod between an operating position to one side of said pedal frame and a stowed position along the other side of said pedal frame and said tubular assembly, means to support said lower cymbal on the upper end of said tubular assembly, means to support said upper cymbal on said upper end of said actuating rod, said upper cymbal being movable by said foot pedal and actuating rod between a first upper position above said lower cymbal, and a second lower position in contact with said lower cymbal, and adjustable means to bias said upper cymbal, actuating rod and foot pedal to said first position.

2. The structure claimed in claim 1 wherein said tubular assembly comprises an upper tubular member and a lower tubular member each having upper and lower ends, said upper tubular member being telescopically received in said lower tubular member, means to maintain said upper tubular member in adjusted vertical position within said lower tubular member, said means to mount said lower cymbal mounting said lower cymbal to said upper end of said upper tubular member, said pedal frame being affixed to said lower end of said lower tubular member, said foldable legs being mounted on said lower tubular member.

3. The structure claimed in claim 2 including a set of legs, a leg mount affixed to said lower end of said lower tubular member adjacent said pedal frame, said leg mount having radially extending lugs, each of said legs comprising a pair of strap-like members having first ends pivotally affixed to either side of one of said leg mount lugs, said strap-like members having second ends which converge toward each other and are joined together with a cylindrical foot located therebetween, a slide bracket being slidably mounted on said lower tubular member above said leg mount and being clampable in any desired vertical position on said lower tubular member, said slide bracket having spaced peripheral lugs, strap-like support arms having first and second ends, the first end of each support arm being pivotally affixed to one of said slide bracket lugs, the second end of each support arm being pivotally affixed to and between said strap-like members of one of said legs, said footed end of said legs being swingable between a downwardly extending supporting position and an upwardly extending stowed position alongside said lower tubular member.

4. The structure claimed in claim 3 wherein said pedal frame comprises a pair of vertical frame portions in parallel spaced relationship and having upper and lower ends, said vertical frame portions being joined by a first horizontal frame portion at said upper ends thereof and a second horizontal portion at a position intermediate said upper and lower ends thereof, said first horizontal portion being affixed to said lower end of said lower tubular member, said lower ends of said vertical pedal frame portions each supporting an adjustable spur, said actuating rod being threaded and extending through perforations in said first and second horizontal pedal frame portions, said adjustable means for biasing said upper cymbal, actuating rod and foot pedal to said first position comprising a coiled compression spring surrounding said actuating rod, an adjustable spring seat threadedly engaged on said actuating rod beneath said first horizontal pedal frame portion, said spring having a first upper end engaging said adjustable spring seat and a second lower end abutting said second horizontal pedal frame portion, and adjustable disc-like stop being threadedly mounted on said actuating rod between said adjustable spring seat and said first horizontal pedal frame portion, a fabric pad mounted on said stop, said stop being so located on said actuating rod as to abut said first horizontal pedal frame portion to determine said first portion of said upper cymbal, said actuating rod and said foot pedal, said means to pivotally connect said forward end of said foot pedal to said actuating rod comprising a bracket of inverted U-shaped configuration having a base portion affixed to said lower end of said actuating rod and downwardly depending leg portions to which and between which said forward end of said foot pedal is pivotally affixed.

5. The structure claimed in claim 4 wherein said means to mount said upper cymbal on said upper end of said actuating rod comprises an upper cymbal holder assembly, said upper end of said actuating rod being unthreaded, said upper cymbal holder assembly comprising a first cylindrical body portion and a second tubular body portion extending therebelow, said body portions having axial bores to receive said upper end of said actuating rod, said upper end of said actuating rod having a sliding fit within said bore of said second body portion, clamping means in association with said first body portion to adjustably engage said upper cymbal holder assembly on said upper end of said actuating rod, the lowermost part of said second body portion being externally threaded, a part of the remainder of said second body portion up to said first body portion being surrounded by a vibration isolation sleeve, a pair of resilient washers being mounted on said second body portion surrounding said vibration isolation sleeve and a threaded friction nut being threadedly engaged on said second body portion beneath said resilient washers, whereby said upper cymbal can be mounted on said second body portion between said resilient washers and held in place by said friction nut.

6. The structure claimed in claim 5 wherein said means to mount said lower cymbal to said upper end of said lower tubular member comprises a support and tilting assembly, said support and tilting assembly comprising a base having a first cylindrical portion affixable to the upper end of said lower tubular member, said base having a disc-like flange surmounting said cylindrical portion, said disc-like flange itself being surmounted by a vertical cylindrical member, said vertical cylindrical member having an axial bore adapted to receive said actuating rod with a sliding fit, said disc-like flange also being surmounted by an annular vertical bearing surface spaced from and surrounding said vertical cylindrical member and having a notch formed therein, an adjustment ring is rotatively mounted on said annular disc-like portion of said base member, said adjustment ring having a central perforation through which said vertical cylindrical member and said annular vertical bearing surface of said base extends and an annular spiral ramp adjacent said base member annular vertical bearing surface, said ramp terminating at its upper and lower ends in vertical stop surfaces, said adjustment ring having an annular horizontal shoulder surrounding and adjacent the exterior of said ramp, a disc-like tilter plate mounted on said adjustment ring and having a central perforation through which said cylindrical member of said base extends, said tilter plate having a downwardly depending lug on its underside, a portion of said lug engaging said ramp and a portion of said lug engaging said notch in said annular vertical bearing surface to preclude rotation of said tilter plate when said adjustment ring is rotated, a resilient washer mounted on the upper surface of said tilter plate, the upper end of said vertical cylindrical member of said base being so sized as to extend through a perforation in said lower cymbal with said lower cymbal resting on said resilient washer, an annular spring seat on said vertical cylindrical member of said base, a coil spring surrounding said vertical cylindrical member of said base with its upper end abutting said spring seat and its lower end abutting said tilter plate to maintain said tilter plate and said adjustment ring in assembly on said base, said adjustment ring being rotatable between a first position wherein said tilter plate lug is in abutment with said vertical stop surface at said lower end of said adjustment ring ramp and said tilter plate and lower cymbal are horizontal, said tilter plate resting on said annular shoulder of said adjustment ring and a second position wherein said tilter plate lug is in abutment with said vertical stop surface at said upper end of said ramp imparting maximum tilt to said tilter plate and said lower cymbal.

7. The structure claimed in claim 6 wherein said actuating rod comprises an upper actuating rod portion and a lower externally threaded actuating rod portion joined end to end by a coupling means.

8. The structure claimed in claim 1 wherein said means to mount said upper cymbal on said upper end of said actuating rod comprises an upper cymbal holder assembly, said upper end of said actuating rod being unthreaded, said upper cymbal holder assembly comprising a first cylindrical body portion and a second tubular body portion extending therebelow, said body portions having axial bores to receive said upper end of said actuating rod, said upper end of said actuating rod having a sliding fit within said bore of said second body portion, clamping means in association with said first body portion to adjustably engage said upper cymbal holder assembly on said upper end of said actuating rod, the lowermost part of said second body portion being externally threaded, a part of the remainder of said second body portion up to said first body portion being surrounded by a vibration isolation sleeve, a pair of resilient washers being mounted on said second body portion surrounding said vibration isolation sleeve and a threaded friction nut being threadedly engaged on said second body portion beneath said resilient washers whereby said upper cymbal can be mounted on said second body portion between said resilient washers and held in place by said friction nut.

9. The structure claimed in claim 8 wherein said second body portion comprises an integral, one-piece part of said first body portion.

10. The structure claimed in claim 8 wherein the upper portion of said axial bore of said first body portion is of enlarged diameter, a clamping ring located within said enlarged bore portion with clearance, said upper end of said actuating rod passing through said ring with clearance, a transverse threaded perforation in said first body portion extending from the exterior thereof to said enlarged bore portion, said means to clamp said upper cymbal holder assembly to said upper end of said actuating rod comprising a wing screw threadedly engaged in said transverse threaded perforation to shift said clamping ring laterally against said upper end of said actuating rod.

11. The structure claimed in claim 8 wherein said friction nut comprises a disc-like member having a threaded axial bore to receive the threaded portion of said second body portion, a transverse notch formed in said nut from the edge thereof, said nut having a pair of transverse perforations extending from said notch through said nut and intersecting said threaded axial bore, a U-shaped friction spring located within said notch with its legs extending into said transverse perforations and frictionally engaging said threaded portion of said second body portion, said nut having a threaded perforation parallel to said threaded axial bore and intersecting said notch, a screw in said threaded perforation to retain said friction spring in place.

12. The structure claimed in claim 1 including a set of legs, a leg mount affixed to said lower end of said tubular assembly adjacent said pedal frame, said leg mount having radially extending lugs, each of said legs comprising a pair of strap-like members having first ends pivotally affixed to either side of one of said leg mount lugs, said strip-like members having second ends which converge toward each other and are joined together with a cylindrical foot located therebetween, a slide bracket being slidably mounted on said tubular assembly above said leg mount and being clampable in any desired vertical position on said tubular assembly, said slide bracket having spaced peripheral lugs, strap-like support arms having first and second ends, the first end of each support arm being pivotally affixed to one of said slide bracket lugs, the second end of each support arm being pivotally affixed to and between said strap-like members of one of said legs, said footed end of said legs being swingable between a downwardly extending supporting position and an upwardly extending stowed position alongside said tubular assembly.

13. The structure claimed in claim 1 wherein said pedal frame comprises a pair of vertical frame portions in parallel spaced relationship and having upper and lower ends, said vertical frame portions being joined by a first horizontal frame portion at said upper ends thereof and a second horizontal portion at a position intermediate said upper and lower ends thereof, said first horizontal portion being affixed to said lower end of said tubular assembly, said lower ends of said vertical pedal frame portions each supporting an adjustable spur, said actuating rod being threaded and extending through perforations in said first and second horizontal pedal frame portions, said adjustable means for biasing said upper cymbal, actuating rod and foot pedal to said first postion comprising a coiled compression spring surrounding said actuating rod, and adjustable spring seat threadedly engaged on said actuating rod beneath said first horizontal pedal frame portion, said spring having a first upper end engaging said adjustable spring seat and a second lower end abutting said second horizontal pedal frame portion, an adjustable disc-like stop being threadedly mounted on said actuating rod between said adjustable spring seat and said first horizontal pedal frame portion, a fabric pad mounted on said stop, said stop being so located on said actuating rod as to abut said first horizontal pedal frame portion to determine said first position of said upper cymbal, said actuating rod and said foot pedal, said means to pivotally connect said forward end of said foot pedal to said actuating rod comprising a bracket of inverted U-shaped configuration having a base portion affixed to said lower end of said actuating rod and downwardly depending leg portions to which and between which said forward end of said foot pedal is pivotally affixed.

14. The structure claimed in claim 1 wherein said means to mount said lower cymbal to said upper end of said tubular assembly comprises a support and tilting assembly, said support and tilting assembly comprising a base having a first cylindrical portion affixable to the upper end of said tubular assembly, said base having a disc-like flange surmounting said cylindrical portion, said disc-like flange itself being surmounted by a vertical cylindrical member, said vertical cylindrical member having an axial bore adapted to receive said actuating rod with a sliding fit, said disc-like flange also being surmounted by an annular vertical bearing surface spaced from and surrounding said vertical cylindrical member and having a notch formed therein, an adjustment ring is rotatively mounted on said disc-like portion of said base member, said adjustment ring having a central perforation through which said vertical cylindrical member and said annular vertical bearing surface of said base extends and an annular spiral ramp adjacent said base member annular vertical bearing surface, said ramp terminating at its upper and lower ends in vertical stop surfaces, said adjustment ring having an annular horizontal shoulder surrounding and adjacent the exterior of said ramp, a disc-like tilter plate mounted on said adjustment ring and having a central perforation through which said cylindrical member of said base extends, said tilter plate having a downwardly depending lug on its underside, a portion of said lug engaging said ramp and a portion of said lug engaging said notch in said annular vertical bearing surface to preclude rotation of said tilter plate when said adjustment ring is rotated, a resilient washer mounted on the upper surface of said tilter plate, the upper end of said vertical cylindrical member of said base being so sized as to extend through a perforation in said lower cymbal with said lower cymbal resting on said resilient washer, an annular spring seat on said vertical cylindrical member of said base, a coil spring surrounding said vertical cylindrical member of said base with its upper end abutting said spring seat and its lower end abutting said tilter plate to maintain said tilter plate and said adjustment ring in assembly on said base, said adjustment ring being rotatable between a first position wherein said tilter plate lug is in abutment with said vertical stop surface at said lower end of said adjustment ring ramp and said tilter plate and lower cymbal are horizontal, said tilter plate resting on said annular shoulder of said adjustment ring, and a second position wherein said tilter plate lug is in abutment with said vertical stop surface at said upper end of said ramp imparting maximum tilt to said tilter plate and said lower cymbal.

15. The structure claimed in claim 1 wherein said actuating rod comprises an upper actuating rod portion and a lower externally threaded actuating rod portion joined end to end by a coupling means.

16. A support and tilting assembly for mounting the lower cymbal of a pair of high-hat cymbals to the upper end of a high-hat stand, of the type having an actuating rod for the upper cymbal of the pair thereof said support and tilting assembly comprising a base having a first cylindrical portion affixable to the upper end of said high-hat stand, said base having a disc-like flange surmounting said first cylindrical portion, said disc-like flange itself being surmounted by a vertical cylindrical member, said vertical cylindrical member having an axial bore adapted to receive said actuating rod with a sliding fit, said disc-like flange also being surmounted by an annular vertical bearing surface spaced from and surrounding said vertical cylindrical member and having a notch formed therein, an adjustment ring is rotatively mounted on said disc-like portion of said base member, said adjustment ring having a central perforation through which said vertical cylindrical member and said annular vertical bearing surface of said base extend and an annular spiral ramp adjacent said base member annular vertical bearing surface, said ramp terminating at its upper and lower ends in vertical stop surfaces, said adjustment ring having an annular horizontal shoulder surrounding and adjacent the exterior of said ramp, a disc-like tilter plate mounted on said adjustment ring and having a central perforation through which said vertical cylindrical member of said base extends, said tilter plate having a downwardly depending lug on its underside, a portion of said lug engaging said ramp and a portion of said lug engaging said notch in said annular vertical bearing surface to preclude rotation of said tilter plate when said adjustment ring is rotated, a resilient washer mounted on the upper surface of said tilter plate, the upper end of said vertical cylindrical member of said base being so sized as to extend through a perforation in said lower cymbal with said lower cymbal resting on said resilient washer, an annular spring seat on said vertical cylindrical member of said base, a coil spring surrounding said vertical cylindrical member of said base with its upper end abutting said spring seat and its lower end abutting said tilter plate to maintain said tilter plate and said adjustment ring in assembly on said base, said adjustment ring being rotatable between a first position wherein said tilter plate lug is in abutment with said vertical stop surface at said lower end of said adjustment ring ramp and said tilter plate and lower cymbal are horizontal, said tilter plate resting on said annular should of said adjustment ring, and a second position wherein said tilter plate lug is in abutment with said vertical stop surface at said upper end of said ramp imparting maximum tilt to said tilter plate and said lower cymbal.

17. An upper cymbal holding assembly for mounting the upper cymbal of a pair of high-hat cymbals to the actuating rod of a high-hat stand, said upper cymbal holder assembly comprising a first cylindrical body portion and a second tubular body portion extending therebelow, said body portions having axial bores to receive said upper end of said actuating rod, the upper portion of said axial bore of said first body portion being of enlarged diameter, said upper end of said actuating rod having a sliding fit within said bore of said second body portion, clamping means in association with said first body portion to adjustably engage said upper cymbal holder assembly on said upper end of said actuating rod, said clamping means comprising, a clamping ring located within said enlarged bore portion with clearance, said upper end of said actuating rod passing through said ring with clearance, a transverse threaded perforation in said first body portion extending from the exterior thereof to said enlarged bore portion, a wing screw threadedly engaged in said transverse threaded perforation to shift said clamping ring laterally against said upper end of said actuating rod, the lowermost part of said second body portion being externally threaded, a part of the remainder of said second body portion up to said first body portion being surrounded by a vibration isolation sleeve, a pair of resilient washers being mounted on said second body portion surrounding said vibration isolation sleeve and a threaded friction nut being threadedly engaged on said second body portion beneath said resilient washers whereby said upper cymbal can be mounted on said second body portion between said resilient washers and held in place by said friction nut.

18. An upper cymbal holding assembly for mounting the upper cymbal of a pair of high-hat cymbals to the actuating rod of a high-hat stand, said upper cymbal holder assembly comprising a first cylindrical body portion and a second tubular body portion extending therebelow, said body portions having axial bores to receive said upper end of said actuating rod, said upper end of said actuating rod having a sliding fit within said bore of said second body portion, clamping means in association with said first body portion to adjustably engage said upper cymbal holder assembly on said upper end of said actuating rod, the lowermost part of said second body portion being externally threaded, a part of the remainder of said second body portion up to said first body portion being surrounded by a vibration isolation sleeve, a pair of resilient washers being mounted on said second body portion surrounding said vibration isolation sleeve and a threaded friction nut being threadedly engaged on said second body portion beneath said resilient washers, said friction nut comprising a disc-like member having a threaded axial bore to receive the threaded portion of said second body portion, a transverse notch formed in said nut from the edge thereof, said nut having a pair of transverse perforations extending from said notch through said nut and intersecting said threaded axial bore, a U-shaped friction spring located within said notch with its legs extending into said transverse perforations and frictionally engaging said threaded portion of said second body portion, said nut having a threaded perforation parallel to said threaded axial bore and intersecting said notch, a screw in said threaded perforation to retain said friction spring in place whereby said upper cymbal can be mounted on said second body portion between said resilient washers and held in place by said friction nut.

* * * * *